US005693155A

United States Patent [19]

Mousseaux et al.

[11] Patent Number: 5,693,155

[45] Date of Patent: Dec. 2, 1997

[54] PROCESS FOR USING ANTI-COKING STEELS FOR DIMINISHING COKING IN A PETROCHEMICAL PROCESS

[75] Inventors: Valérie Mousseaux, Paris; François Ropital, Malmaison; André Sugier, Le Cros de Cagnes, all of France

[73] Assignee: Institut Francais du Petrole, Rueil Malmaison, France

[21] Appl. No.: 575,546

[22] Filed: Dec. 20, 1995

[30] Foreign Application Priority Data

Dec. 20, 1994 [FR] France ..... 94 15453

[51] Int. Cl.[6] ..... C22C 38/34; C22C 38/40

[52] U.S. Cl. ..... 148/327; 420/50; 420/51

[58] Field of Search ..... 148/327; 138/146; 420/50, 51

[56] References Cited

U.S. PATENT DOCUMENTS

| | | | |
|---|---|---|---|
| 3,910,788 | 10/1975 | Fujioka et al. | 75/125 |
| 4,102,225 | 7/1978 | Michels | 75/124 |
| 4,999,159 | 3/1991 | Uematsu et al. | 420/53 |
| 5,223,214 | 6/1993 | Culling | 420/41 |

FOREIGN PATENT DOCUMENTS

| | | |
|---|---|---|
| 0 190 408 | 8/1986 | European Pat. Off. . |
| 2 255 388 | 7/1975 | France . |

OTHER PUBLICATIONS

Abstract, JP 2-156049, Jun. 15, 1990.

*Primary Examiner*—Deborah Yee

*Attorney, Agent, or Firm*—Millen, White, Zelano, & Branigan, P.C.

[57] ABSTRACT

For diminishing coking in a petrochemical process, coking-resistant steel containing by weight:

about 0.05% to 0.06% of carbon;

about 2.5% to 5% of silicon;

10% to 20% of chromium;

10% to 15% of nickel 0.5% to 1.5% of manganese;

0–0.5% of titanium;

at most 0.8% of aluminium;

the complement to 100% being essentially iron, can be used to manufacture tubes and plates for producing reactors or elements thereof, as well as for coatings of the internal walls of furnaces, reactors or tubings where coking can occur.

15 Claims, 3 Drawing Sheets

Figure 1:
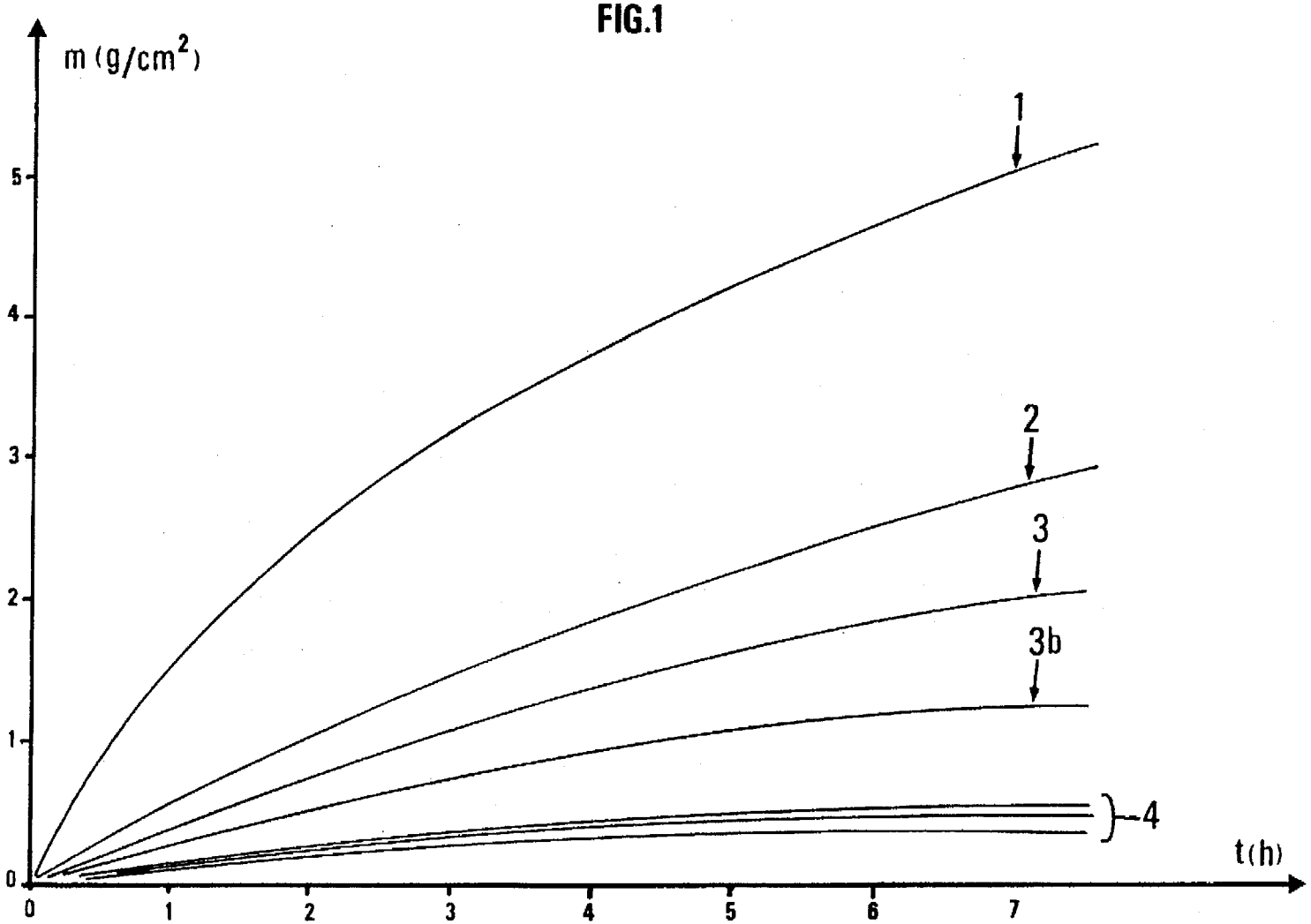

PROCESS FOR USING ANTI-COKING STEELS FOR DIMINISHING COKING IN A PETROCHEMICAL PROCESS

BACKGROUND OF THE INVENTION

The present invention concerns steels for the manufacture of reactors, furnaces, tubings or some of their elements, particularly for use in petrochemical processes, the steels having an improved resistance to coking.

The invention also concerns the manufacture of reactors, furnaces, tubings or certain of their elements using these steels.

The carbonaceous deposit which forms in furnaces during hydrocarbon conversion is generally termed coke. This coke deposit is a problem in industrial units. The formation of coke on tube and reactor walls reduces thermal exchange and causes major blockages, thus increasing pressure drops. To keep the reaction temperature constant, it may be necessary to increase the wall temperature, risking damage to the constituent alloy of the walls. A reduction in plant selectivity, and thus the yield is also observed.

Periodically, then, the plants have to be stopped to carry out decoking. It is thus of economic interest to develop materials or coatings which can reduce coke formation.

Japanese patent application JP 03-104 843 describes a refractory anti-coking steel for a furnace tube for ethylene steam cracking. This steel, however, contains more than 15% of chromium and of nickel, and less than 0.4% of manganese. This steel was developed to limit the formation of coke between 750° C. and 900° C. for steam cracking of a naphtha, ethane or a gas oil.

SUMMARY OF THE INVENTION

The present invention thus concerns steels with a well-defined composition to produce good resistance to coking. These steels have the following composition by weight:

about 0.05% of carbon;

2.5% to 5% of silicon;

10% to 20% of chromium;

10% to 15% of nickel;

0.5% to 1.5% of manganese;

at most 0.8% of aluminum;

the complement to 100% being essentially iron.

The steels of the invention may also contain 0.25% to about 0.5% by weight of titanium.

In a variation of the invention, the steels have the following composition by weight:

about 0.06% of carbon;

about 3.5% to 5% of silicon;

about 17.5% of chromium;

about 10% of nickel;

about 1.2% of manganese;

about 0.5% of titanium; and about 0.07% of aluminum;

the complement to 100% being essentially iron.

They may then have an austeno-ferritic structure.

In a further variation of the invention, the steels have the following composition:

about 0.05% of carbon;

about 2.5% to 3% of silicon;

about 17% to 17.5% of chromium;

about 12% of nickel;

about 1.2% of manganese;

about 0.35% of titanium; and about 0.06% of aluminum;

the complement to 100% being essentially iron.

They may then have an austenitic structure.

The invention also concerns a process for the manufacture of elements for plants for petrochemical processes carried out at temperatures of between 350° C. and 1100° C. to improve the resistance of these elements to coking, manufactured entirely or partially using a steel as defined above.

These steels can be used to manufacture plants using petrochemical processes, for example catalytic or thermal cracking, or dehydrogenation.

During dehydrogenation of isobutane, for example, at between 550° C. and 700° C. to produce isobutene, a secondary reaction results in the formation of coke. This coke formation is catalytically activated by the presence of nickel, iron and their oxides.

A further application is in a steam cracking process for substances such as a naphtha, ethane or a gas oil, leading to the formation of light unsaturated hydrocarbons, in particular ethylene, etc., at temperatures of 750° C. to 1100° C.

The steels of the invention can be used to manufacture entire tubes or plates for the manufacture of furnaces or reactors.

In this case, the steels of the present invention can be formed using conventional casting and molding methods, then shaped using the usual techniques to produce sheets, grates, tubes, profiles etc. These semi-finished products can be used to construct the principal parts of reactors or only the accessory or auxiliary portions.

The steels of the invention can also be used to coat the internal walls of furnaces, reactors or tubings, using at least one of the following techniques: co-centrifuging, plasma, electrolytic, overlay. These steels can then be used in powder form to coat the internal walls of reactors, grates or tubes, in particular after assembly of the plants.

Figure 2:
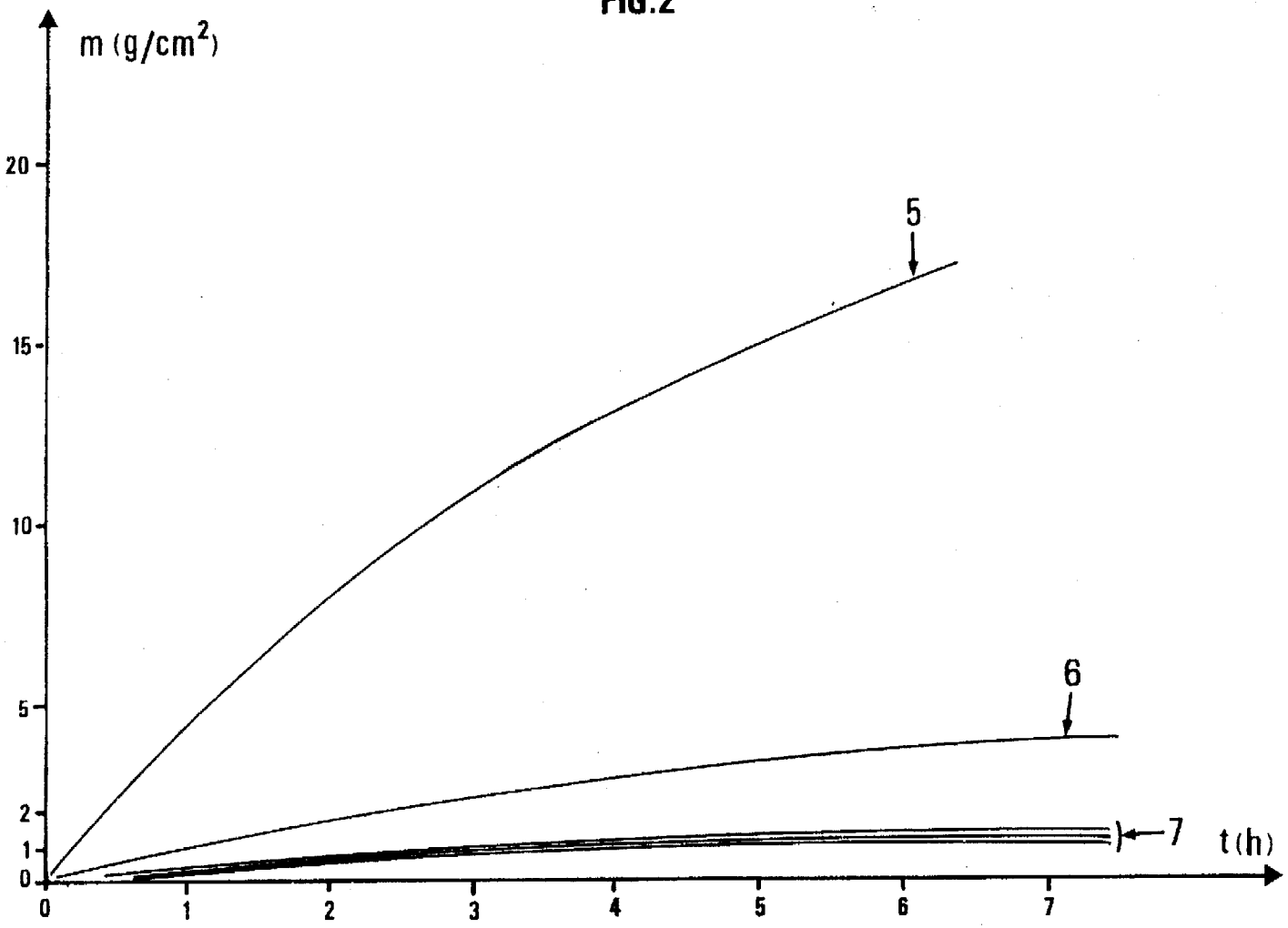
Figure 3:
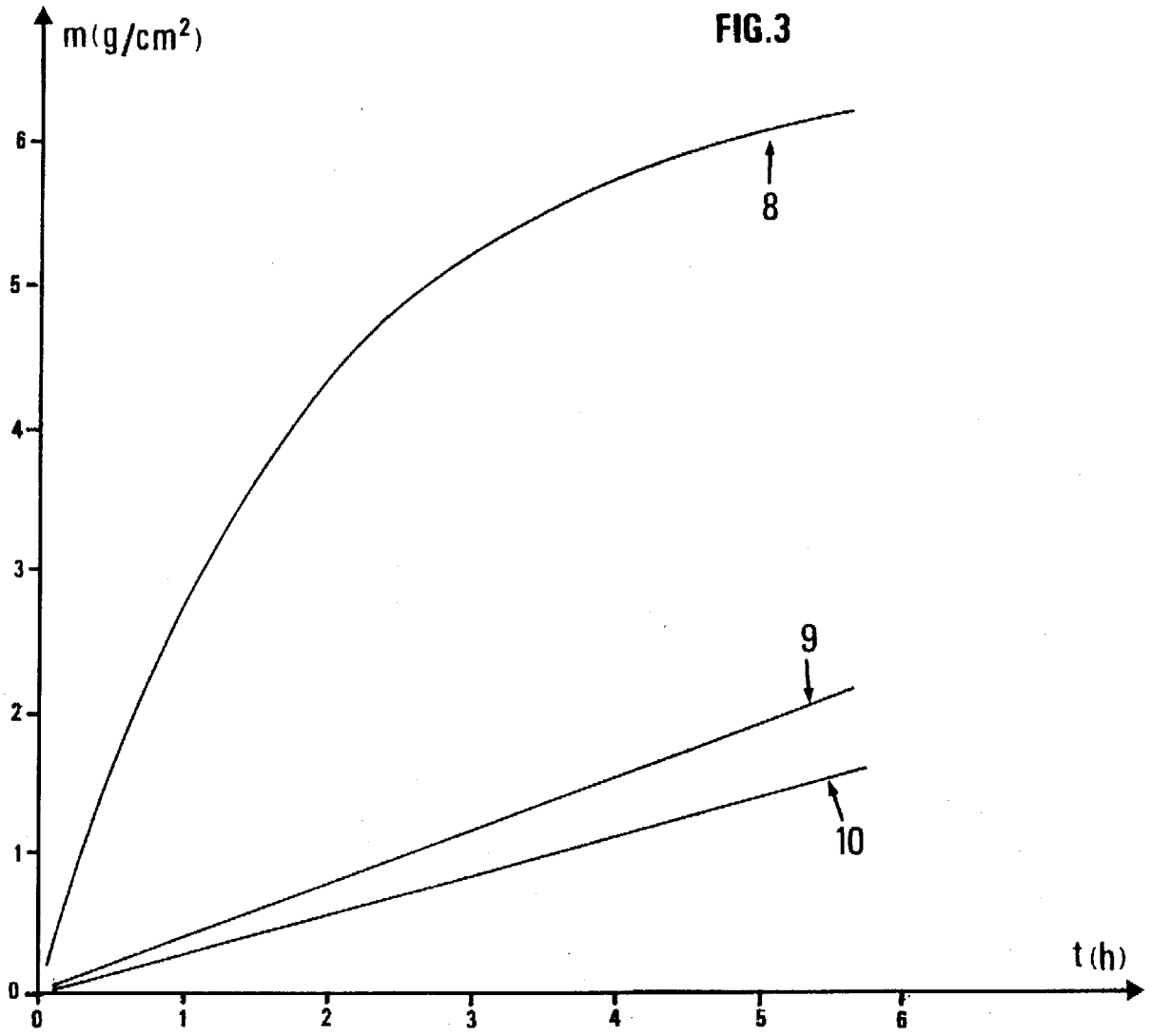

The invention will be better understood and its advantages will be more clear from the following non limiting examples and tests which are illustrated in the accompanying drawings, in which:

FIG. 1 shows coking curves for different steels during dehydrogenation of isobutane;

FIG. 2 compares the cumulative effect of coking plus decoking for the steels of the invention compared with the same reaction for a standard steel;

FIG. 3 shows coking curves for different steels for steam cracking of hexane.

The steels used in the examples had the compositions shown below: (weight %):

| STEEL | C | Si | Mn | Ni | Cr | S | P | Al | Ti |
|---|---|---|---|---|---|---|---|---|---|
| SS | 0.06 | 0.5 | 1.1 | 10 | 17.5 | 0.015 | <0.04 | 0.07 | 0.5 |
| F1 | 0.37 | 2.31 | | | 10.25 | | | | |
| D1 | 0.04 | 1.9 | 1.3 | 12.5 | 19.3 | 0.001 | 0.02 | 0.06 | 0.005 |

-continued

| STEEL | C | Si | Mn | Ni | Cr | S | P | Al | Ti |
|---|---|---|---|---|---|---|---|---|---|
| D2 | 0.2 | 3.6 | 0.8 | 14.5 | 18.5 | 0.015 | <0.04 | 1.0 | <0.01 |
| C1 | 0.06 | 5 | 1.2 | 10 | 17.5 | 0.015 | <0.04 | 0.07 | 0.5 |
| C2 | 0.06 | 3.5 | 1.2 | 10 | 17.5 | 0.015 | <0.04 | 0.07 | 0.5 |
| C3 | 0.05 | 3 | 1.2 | 12 | 17.5 | 0.015 | <0.04 | 0.06 | 0.35 |
| C4 | 0.05 | 2.5 | 1.2 | 12 | 17.0 | 0.05 | <0.04 | 0.06 | 0.35 |

SS is a standard steel which is currently used for the manufacture of reactors of reactor elements. Steels F1, D1 and D2 are also shown for comparison.

EXAMPLE 1

Different alloys were tested in an isobutane dehydrogenation reactor. The dehydrogenation of isobutane produces isobutene. A secondary reaction is the formation of coke. At the temperatures used for isobutane dehydrogenation, the coke deposit is mainly constituted by catalytic coke.

Steel F1 had a ferritic structure, steels C1 and C2 had an austeno-ferritic structure and steels C3 and C4 had an austenitic structure. The chromium and nickel contents of steels C3 and C4 were adjusted using Guiraldenq and Pryce equivalence coefficients in order to locate the steels in the single phase austenitic region of the Schaeffer diagram.

Alloys C1, C2, C3 and C4 could develop a stable oxide layer which was inert to catalytic coking phenomena. The presence of silicon in the alloys encouraged formation of an external, substantially continuous layer constituted practically solely of chromium oxide without spinel oxides Cr_Ni_Fe. This chromium oxide layer was separated from the metallic substrate by an oxide zone which was rich in silicon. The atmosphere of the chemical reaction, for example isobutane dehydrogenation, was thus practically solely in contact with a chromium oxide layer which was catalytically inert to coking.

The operating procedure used to carry out the tests was as follows:

- the steel samples were cut out by electroerosive machining then polished with SiC #180 paper to produce a standard surface and remove the oxide crust which could have formed during cutting.
- Degreasing was carried out in a $CCl_4$, acetone then ethanol bath.
- The samples were then suspended in the arms of a thermobalance.
- The tube reactor was then closed. The temperature was raised in an argon atmosphere.
- The reaction mixture, consisting of isobutane, hydrogen and argon and about 300 ppm of oxygen, was injected into the reactor.

The microbalance allowed continuous measurement of the weight gain of the sample.

FIG. 1 shows a graph with the time in hours along the abscissa and the weight of coke formed on the sample during the reaction up the ordinate, the weight being given in grams per square centimeter ($g/m^2$). Curve 1 relates to steel SS, curve 2 relates to steel F1, curves 3 and 3*b* relate respectively to steels D1 and D2, and curves 4 relate to steels C1, C2, C3 and C4.

It is clear that, for steels C1, C2, C3 and C4 of the invention, the amount of coking was reduced. Under the same conditions, steels F1, D1 and D2 showed less resistance to coking.

FIG. 2 shows the coking curves during several successive coking/decoking cycles. Decoking was carried out in air at 600° C. for the time necessary to burn off the deposited coke (5 to 10 minutes). Curve 6 represents the coking for steel SS in the first cycle, curve 5 represents the coking for the SS steel sample after 20 coking/decoking cycles.

Curves 7 represent the coking/decoking curves after 20 cycles for steels C3 and C4.

After 20 coking/decoking cycles, steels C3 and C4 had the same resistance to coking. The surface chromium oxide layer had not moved and it retained its very low original catalytic activity as regards coking. On the other hand, for the standard steel which contained practically no silicon, after 20 coking/decoking cycles, the amount of carbon deposit after 6 hours of the test had multiplied by four. The protective layer on the standard steel was not stable: during successive decoking steps, this layer was enriched in catalytic metallic element such as iron or nickel.

EXAMPLE 2

A second test was carried out using a hexane steam cracking reaction at a temperature of about 850° C. The procedure used for preparing the steel samples was the same as for Example 1.

FIG. 3 shows the coking of an SS steel sample, shown in curve 8, which was substantially higher than curves 9 and 10 representing the coking of steels C4 and C3 respectively.

For the second test, alloys C3 and C4, which contained silicon, had less coking than that of standard steels.

The good mechanical thermal characteristics of steels C3 and C4 of the invention should be noted:

| 1<br>T<br>(°C.) | 2<br>Re<br>(MPa) | 3<br>Rm<br>(MPa) | 4<br>E<br>(%) | 5<br>$t_{rup}$<br>10000<br>(MPa) | 6<br>$t_{rup}$<br>100000<br>(MPa) | 7<br>$t_{1\%}$<br>10000<br>(MPa) |
|---|---|---|---|---|---|---|
| 600 | 140 | 370 | 40 | 210 | 150 | 140 |
| 700 | 130 | 320 | 44 | 75 | 30 | 50 |
| 800 | 120 | 300 | 50 | 15 | 7.5 | 8 |

Column 1 shows the sample temperature; column 2 shows the yield stress; column 3 shows the breaking stress; column 4 shows the elongation at break. Column 5 shows the breaking stress during a creep test after 10000 hours; column 6 shows the same after 100000 hours; and column 7 shows the stress for an elongation of 1% in a creep test after 10000 hours.

We claim:

1. A process for diminishing coking in a petrochemical process carried out at temperatures of between 350° C. and 1100° C. in contact with a surface subjectable to coking, comprising providing said surface at least in part, with a steel consisting essentially of, by weight:

about 0.05% to about 0.06% of carbon;

2.5% to 5% of silicon;

10% to 20% of chromium;

10% to 15% of nickel 0.5% to 1.5% of manganese:

at most 0.8% of aluminum;

0 to 0.5% of titanium;

the complement to 100% being iron, thereby diminishing said coking compared to surfaces made from other steels.

2. A process according to claim 1, wherein the steel contains 0.25% to about 0.5% by weight of titanium.

3. A process according to claim 1, wherein the steel consists essentially of the following composition by weight:

about 0.06% of carbon;

about 3.5% to 5% of silicon;

about 17.5% of chromium;

about 10% of nickel;

about 1.2% of manganese;

about 0.5% of titanium; and about 0.07% of aluminum;

the complement to 100% being essentially iron.

4. A process according to claim 3, wherein the steel has an austeno-ferritic structure.

5. A process according to claim 1, wherein the steel consists essentially of following composition by weight:

about 0.05% of carbon;

about 2.5% to 3% of silicon;

about 17% to 17.5% of chromium;

about 12% of nickel;

about 1.2% of manganese;

about 0.35% of titanium; and about 0.06% of aluminum;

the complement to 100% being essentially iron.

6. A process according to claim 5, wherein the steel has an austenitic structure.

7. A process according to claim 1, wherein that said surface comprises elements manufactured entirely from said steel.

8. A process according to claim 1, wherein the surface is a coating of said steel on an internal wall of an element used in the petrochemical process.

9. A process according to claim 8, wherein said coating is effected at least one technique selected from co-centrifuging, plasma, electrolytic coating and overlay techniques.

10. A process according to claim 1, wherein the process is conducted in an isobutane dehydrogenation unit operating at 550°–700° C.

11. A process according to claim 1, wherein the process is conducted in a naphtha, ethane or gas oil steam cracking unit operating at between 750° C. and 1100° C.

12. A process according to claim 1, wherein the carbon content of the steel is about 0.05% by weight.

13. A process according to claim 1, wherein the petrochemical process is conducted, at least partially, in a furnace or reactor and the entire inner surface of the furnace or reactor has a surface of said steel.

14. A process according to claim 1, wherein the steel has a content of about 10–12% by weight of nickel.

15. A process according to claim 1, wherein the steel has an aluminum content of about 0.06 to 0.07% aluminum.

* * * * *